US009844955B2

(12) United States Patent
Sano

(10) Patent No.: US 9,844,955 B2
(45) Date of Patent: Dec. 19, 2017

(54) IMAGE RECORDING APPARATUS

(71) Applicant: Brother Kogyo Kabushiki Kaisha, Nagoya-shi, Aichi-ken (JP)

(72) Inventor: Iwane Sano, Obu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/865,697

(22) Filed: Sep. 25, 2015

(65) Prior Publication Data

US 2016/0089902 A1 Mar. 31, 2016

(30) Foreign Application Priority Data

Sep. 25, 2014 (JP) ..... 2014-194779

(51) Int. Cl.
*B41J 11/00* (2006.01)

(52) U.S. Cl.
CPC ..... *B41J 11/005* (2013.01)

(58) Field of Classification Search
CPC ..... B41J 13/0027; B41J 13/02; B41J 13/14; B41J 11/005; B41J 11/007; B41J 13/08
USPC ..... 347/104
See application file for complete search history.

(56) References Cited

U.S. PATENT DOCUMENTS

2013/0135388 A1 5/2013 Samoto et al.
2013/0135412 A1* 5/2013 Kawamata ..... B41J 11/0035 347/104
2013/0135413 A1* 5/2013 Ito ..... B41J 11/06 347/104

FOREIGN PATENT DOCUMENTS

JP 2013-136225 A 7/2013

* cited by examiner

*Primary Examiner* — Sharon A Polk
(74) *Attorney, Agent, or Firm* — Banner & Witcoff, Ltd.

(57) ABSTRACT

There is provided an image recording apparatus, including: a conveyance unit configured to convey the sheet in a sheet conveyance direction; a recording unit configured to record the image on the sheet conveyed by the conveyance unit; a support member having a first surface and a second surface which is opposite to the first surface, the first surface being configured to support the recording unit; a contact member including an engaging part configured to engage with the first surface and a contact part configured to make contact with the sheet on a downstream side of the engaging part in the sheet conveyance direction; and an biasing member configured to bias the contact member toward the second surface of the support member between the contact part and the engaging part in the sheet conveyance direction, and thereby making the contact member contact with the second surface.

13 Claims, 8 Drawing Sheets

IMAGE RECORDING APPARATUS

CROSS REFERENCE TO RELATED APPLICATION

The present application claims priority from Japanese Patent Application No. 2014-194779 filed on Sep. 25, 2014, the disclosure of which is incorporated herein by reference in its entirety.

BACKGROUND

Field of the Invention

The present teaching relates to an image recording apparatus configured to make a sheet on which an image is recorded by a recording unit contact with a contact member, thereby preventing the sheet from floating.

Description of the Related Art

There is conventionally known an ink-jet recording apparatus which records an image by discharging ink droplets onto a sheet, such as a recording sheet, from nozzles provided for a recording unit. The ink-jet recording apparatus includes a platen (a sheet support member), which is disposed to face the recording unit and supports the sheet. The recording unit is slidably supported by a pair of guide rails, which is provided on upstream and downstream sides in a sheet conveyance direction to extend in a width direction orthogonal to the sheet conveyance direction.

When the sheet is conveyed on the platen, the recording unit selectively discharges ink droplets on the sheet on the platen while moving on the pair of guide rails in the width direction orthogonal to the sheet conveyance direction. Accordingly, the image is recorded on the sheet.

The ink-jet recording apparatus may have such a phenomenon (cockling) that a part, of the sheet, to which the ink is adhering, swells and floats from the platen. The cockling causes the part of the sheet floating from the platen to make contact with the recording unit and/or a guide member which guides the sheet to the platen. This could lead to a defective image, a paper jam, etc.

In order to solve the above problem, there has been conventionally known an image recording apparatus, which includes contact members in a guide rail disposed on the upstream side in a sheet conveyance direction and is configured to press a sheet conveyed on a platen against the platen. Each of the contact members includes an attachment part, a curved part, and a flat-plate contact part. The attachment part is brought into contact with the lower surface of the guide rail. The curved part extends from the attachment part toward the downstream side in the sheet conveyance direction in a state of being curved downward. The flat-plate contact part extends from the lower end of the curved part toward the downstream side in the sheet conveyance direction.

The attachment parts of the contact members are attached to the guide rail so that four engaging parts are engaged with the guide rail. Two of the four engaging parts are provided as a pair on the upstream side, and the other two engaging parts are provided as a pair on the downstream side. The engaging parts pass through openings penetrating the guide rail in an up-down direction to be engaged with the upper surface of the guide rail.

The curved parts hang down from the attachment parts. The contact parts are pushed upward by being brought into contact with a sheet conveyed. Then, the reaction force from the contact parts presses the sheet against the platen, thereby preventing the sheet from floating from the platen.

In the image recording apparatus, the engaging parts of the contact members are engaged with the guide rail with clearance (backlash) intervening therebetween. This allows the contact parts to move upward when the contact parts are brought into contact with the sheet. When the contact parts are not brought into contact with the sheet, the contact parts are inclined so that its front ends on the downstream side in the sheet conveyance direction are positioned on the lowermost side.

In the above structure or configuration, when the contact parts are pushed upward by being brought into contact with the sheet, the attachment parts rotate around the engaging parts provided, as the pair, on the upstream side in the sheet conveyance direction. Then, when the contact parts are pushed upward to a position where appropriate pressing force is applied to the sheet, the guide rail regulates the attachment parts not to move the contact parts from this position.

As described above, the guide rail regulates the attachment parts to position the contact parts. The pressing force applied from the contact parts to the sheet is also influenced by the weight of the curved parts and contact parts. Thus, it is difficult to perform adjustments of positions of the contact parts in the up-down direction in which the appropriate pressing force, which fails to change the position of the sheet, is applied to the sheet.

Further, the above image recording apparatus may have the following structure or configuration. Namely, when the paper jam of the sheet on the platen occurs in the image recording apparatus, the sheet is pulled toward a direction opposite to the sheet conveyance direction in order to clear the paper jam. In this case, the contact parts are inclined so that the front ends thereof are positioned on the lowermost side, and thus the front ends of the contact parts may pierce the sheet pulled toward the direction opposite to the sheet conveyance direction. This could lead to the damage of the sheet or the worsening of the paper jam.

The present teaching has been made in view of the abovementioned circumstances, and an object of the present teaching is to provide an image recording apparatus which allows contact parts of contact members to make contact appropriately with a sheet on which an image is recorded by a recording unit.

SUMMARY

An image recording apparatus according to the present teaching includes: a conveyance unit configured to convey the sheet in a sheet conveyance direction;

a recording unit configured to record the image on the sheet conveyed by the conveyance unit;

a support member having a first surface and a second surface which is opposite to the first surface, the first surface being configured to support the recording unit;

a contact member including an engaging part configured to engage with the first surface and a contact part configured to make contact with the sheet on a downstream side of the engaging part in the sheet conveyance direction; and an biasing member configured to bias the contact member toward the second surface of the support member between the contact part and the engaging part in the sheet conveyance direction, and thereby making the contact member contact with the second surface.

The image recording apparatus having this structure can easily adjust the position of the contact part to the second surface of the support member by means of the biasing member.

According to the present teaching, the contact part of the contact member can make contact appropriately with the sheet on which the image is recorded by the recording unit.

DESCRIPTION OF THE EMBODIMENTS

Figure 1:
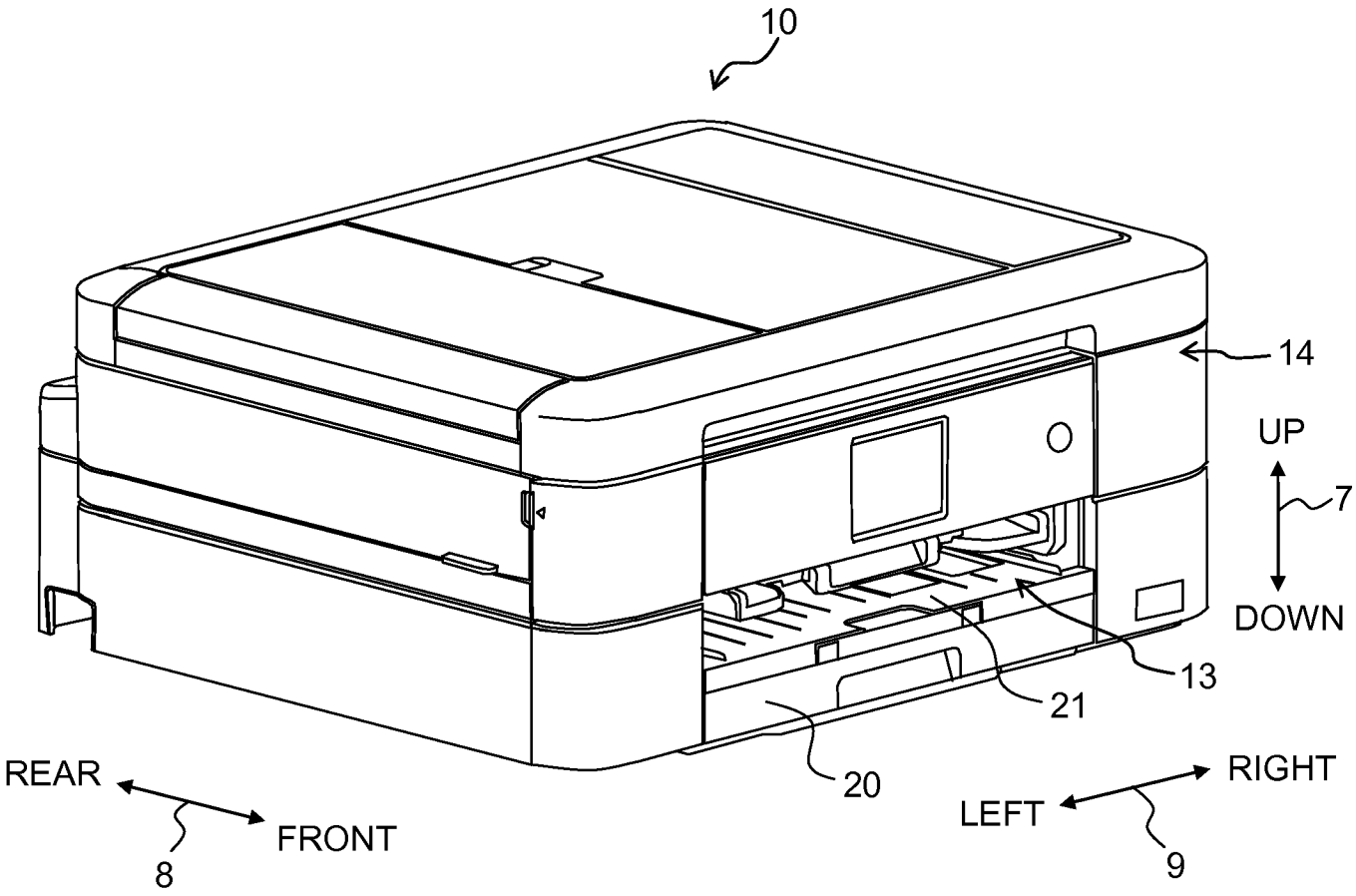
FIG. 1 is a perspective view of a multi peripheral 10 in accordance with an embodiment of the present teaching.

In the following, an explanation will be made with reference to the drawings about an embodiment of the present teaching. It is needless to say that the embodiment to be explained below is merely an example of the present teaching, and it is possible to appropriately change the embodiment of the present teaching without departing from the gist and scope of the present teaching. In the following explanation, an up-down direction 7 is defined on the basis of the state in which a multifunction peripheral 10 is placed to be usable (the state depicted in FIG. 1). A front-rear direction 8 is defined as a discharge space 13 of the multifunction peripheral 10 is provided on the near side (the front side). A left-right direction 9 is defined as the multifunction peripheral 10 is viewed from the near side (the front side).

<Entire Structure of Multifunction Peripheral 10>

The multifunction peripheral 10 depicted in FIG. 1 (an exemplary image recording apparatus of the present teaching) has various functions such as a facsimile function and a print function. The multifunction peripheral 10 includes a casing 14 and feed tray 20. The casing 14 is thin and has an approximately cuboid form. The feed tray 20 is installed in a lower part of the casing 14, and can be pulled forward from the casing 14.

The casing 14 includes a discharge space 13 on the upper side of the front part of the installed feed tray 20. The discharge space 13 is open on the front side and a recording sheet 12 for which printing has been performed is discharged into the discharge space 13. A discharge tray 21 is provided on the lower side of the discharge space 13, and the recording sheet 12 (see FIG. 2), which is an exemplary sheet for which printing is performed, is discharged into the discharge space 13 and then placed on the discharge tray 21. The discharge tray 21 is supported on the feed tray 20.

Figure 2:
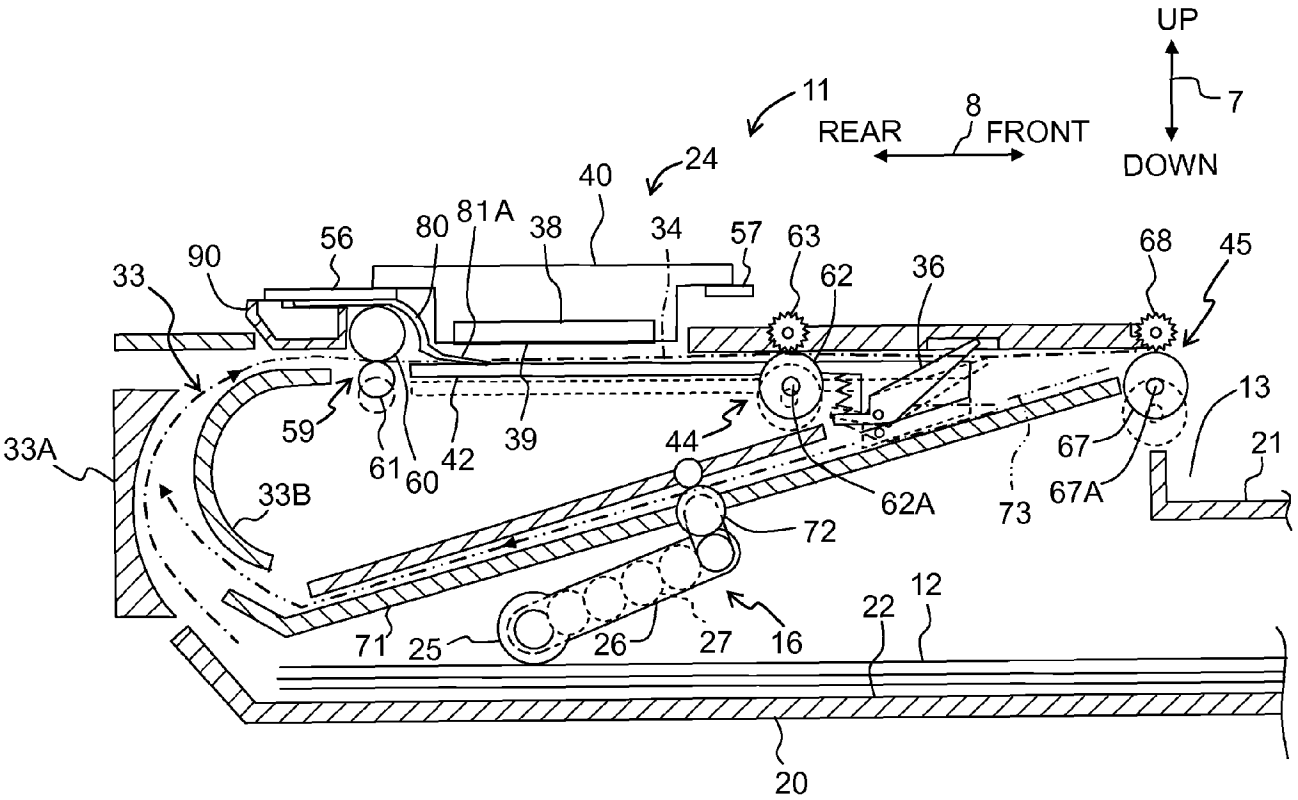
FIG. 2 schematically depicts a structure of a printer unit 11.

As depicted in FIG. 2, the printer unit 11 is provided on the upper-rear side of the casing 14. The printer unit 11 of the ink-jet type records an image on a recording medium, such as the recording sheet 12. The feed tray 20 includes a support surface 22 on which recording sheets 12 are stacked in the up-down direction 7. The multifunction peripheral 10 has functions to record an image on one side of the recording sheet 12 and to record images on both sides of the recording sheet 12, the recording sheet 12 being fed from the support surface 22 of the feed tray 20. Further, the multifunction peripheral 10 has a function to record an image on a disk of a recording media, such as CD-ROM and DVD-ROM.

A feed unit 16 is provided on the lower side of the printer unit 11 to feed the recording sheet 12 in the feed tray 20 to the printer unit 11. The feed unit 16 includes a feed roller 25 which feeds an uppermost recording sheet 12 in the feed tray 20 toward the upper rear side while making contact with the uppermost recording sheet 12. The feed roller 25 is rotatably supported by a support arm 26 between a position where the feed roller 25 makes contact with the uppermost recording sheet 12 in the feed tray 20 and a position where the feed roller 25 is separated from the uppermost recording sheet 12 in the up-down direction 7. A power transmitting mechanism 27 transmits power of an unillustrated motor to the feed roller 25.

A first conveyance path 33 is provided in a rear part of the casing 14 and each recording sheet 12, which is fed from the feed tray 20 by means of the feed unit 16, is conveyed upward through the first conveyance path 33. The first conveyance path 33 is formed of an outer guide member 33A positioned on the rear side and an inner guide member 33B positioned on the front side to have an arc-like shape curved rearward. The recording sheet 12 is conveyed through the first conveyance path 33 on the basis of central positioning, which allows the recording sheet 12 to be conveyed so that the center of the recording sheet 12 in its width direction orthogonal to the sheet conveyance direction is roughly coincident with the center of the first conveyance path 33 in its width direction.

The recording sheet 12 fed from the feed tray 20 enters the first conveyance path 33 through the lower end of the first conveyance path 33 and then is discharged forward through the upper end of the first conveyance path 33. A second conveyance path 34 is provided in an upper part of the printer unit 11 to extend in the front-rear direction 8. The recording sheet 12 conveyed from the first conveyance path 33 is conveyed forward through the second conveyance path 34. The second conveyance path 34 extends from the upper end of the first conveyance path 33 to the upper side of the rear end of the discharge tray 21.

The second conveyance path 34 includes a first conveyance roller pair 59 (corresponding to a conveyance unit), a platen 42, a second conveyance roller pair 44, a path switching unit 36, and a reverse roller pair 45, and they are disposed from the rear side to the front side in the above-described order. Each of the first conveyance roller pair 59, the platen 42, the second conveyance roller pair 44, the path switching unit 36, and the reverse roller pair 45 defines a part of the second conveyance path 34. The recording sheet 12 is conveyed through the second conveyance path 34 on the basis of central positioning as described above.

The first conveyance roller pair 59 includes a first conveyance roller 60 disposed on the upper side and a pinch roller 61 disposed on the lower side. When the recording sheet 12 is conveyed through the second conveyance path 34, the first conveyance roller 60 of the first conveyance roller pair 59 is driven to rotate in a state of being brought in tight contact with the pinch roller 61.

The recording sheet 12, which is conveyed through the second conveyance path 34, is supported to extend in the front-rear direction 8 by the platen 42 disposed between the first conveyance roller pair 59 and the second conveyance roller pair 44 in the front-rear direction 8. A recording unit 24 is provided on the upper side of the platen 42. The recording unit 24 records an image on the recording sheet 12 supported by the platen 42.

The recording unit 24 is supported on the upper side of the platen 42 by a first guide rail 56 and a second guide rail 57, which are disposed to extend in the left-right direction 9 with a predetermined spacing distance intervening therebetween in the front-rear direction 8. The recording unit 24 includes a carriage 40 and a recording head 38. The carriage 40 is slidably supported by the first guide rail 56 and the second guide rail 57. The recording head 38 is disposed at a lower part of the carriage 40. The recording head 38 includes nozzles 39 from which the ink is discharged downward. The ink is supplied from an ink cartridge (not depicted) to the nozzles 39. The recording unit 24 forms an image, on the basis of central positioning in the width direction of the recording sheet 12, on the recording sheet 12 on the platen 42 which has been conveyed on the basis of the central positioning.

The second conveyance roller pair 44 disposed on the front side of the platen 42 includes a second conveyance roller 62 disposed on the lower side and a facing roller (driven roller) 63 disposed on the upper side. When the recording sheet 12 is conveyed, the second conveyance roller 62 of the second conveyance roller pair 44 is driven to rotate in a state of being brought into tight contact with the facing roller 63.

When the recording sheet 12 conveyed by the second conveyance roller pair 44 is brought in contact with the path switching unit 36, the recording sheet 12 is allowed to pass above the path switching unit 36. As will be described later, when the conveyance direction of the recording sheet 12 which has been guided by the path switching unit 36 toward the reverse roller pair 45 is reversed to be conveyed rearward, the recording sheet 12 makes contact with the path switching unit 36 and then is guided to the lower side of the path switching unit 36.

The reverse roller pair 45 includes a reverse roller 67 disposed on the lower side and a facing roller (driven roller) 68 disposed on the upper side. The reverse roller 67 is rotatable in normal and reverse directions (rotatable forward and rearward). When the facing roller 68 is brought in tight contact with the reverse roller 67, the facing roller 68 rotates following the rotation of the reverse roller 67.

The reverse roller 67 rotates in a direction in which the recording sheet 12 is conveyed forward (referred to as "normal rotation") and in a direction in which the recording sheet 12 is conveyed rearward (referred to as "reverse rotation"). When an image is recorded on only one side of the recording sheet 12, the reverse roller 67 of the reverse roller pair 45 rotates in the normal direction to discharge the recording sheet 12 on the discharge tray 21.

When images are recorded on both sides of the recording sheet 12, the reverse roller 67 at first rotates in the normal direction. When the rear end of the recording sheet 12, which has the image recorded on one side, reaches the reverse roller pair 45, the reverse roller 67 rotates in the reverse direction. This conveys the recording sheet 12 rearward (toward the path switching unit 36) to guide the recording sheet 12 on the lower side of the path switching unit 36. A branched conveyance guide 71 is provided on the lower side of the path switching unit 36 to range from the reverse roller pair 45 to the lower end of the first conveyance path 33. The branched conveyance guide 71 forms a third conveyance path 73. The recording sheet 12 is conveyed along the branched conveyance guide 71 to the lower end of the first conveyance path 33 by means of an immediate conveyance roller pair 72.

<Printer Unit 11>

Figure 3:
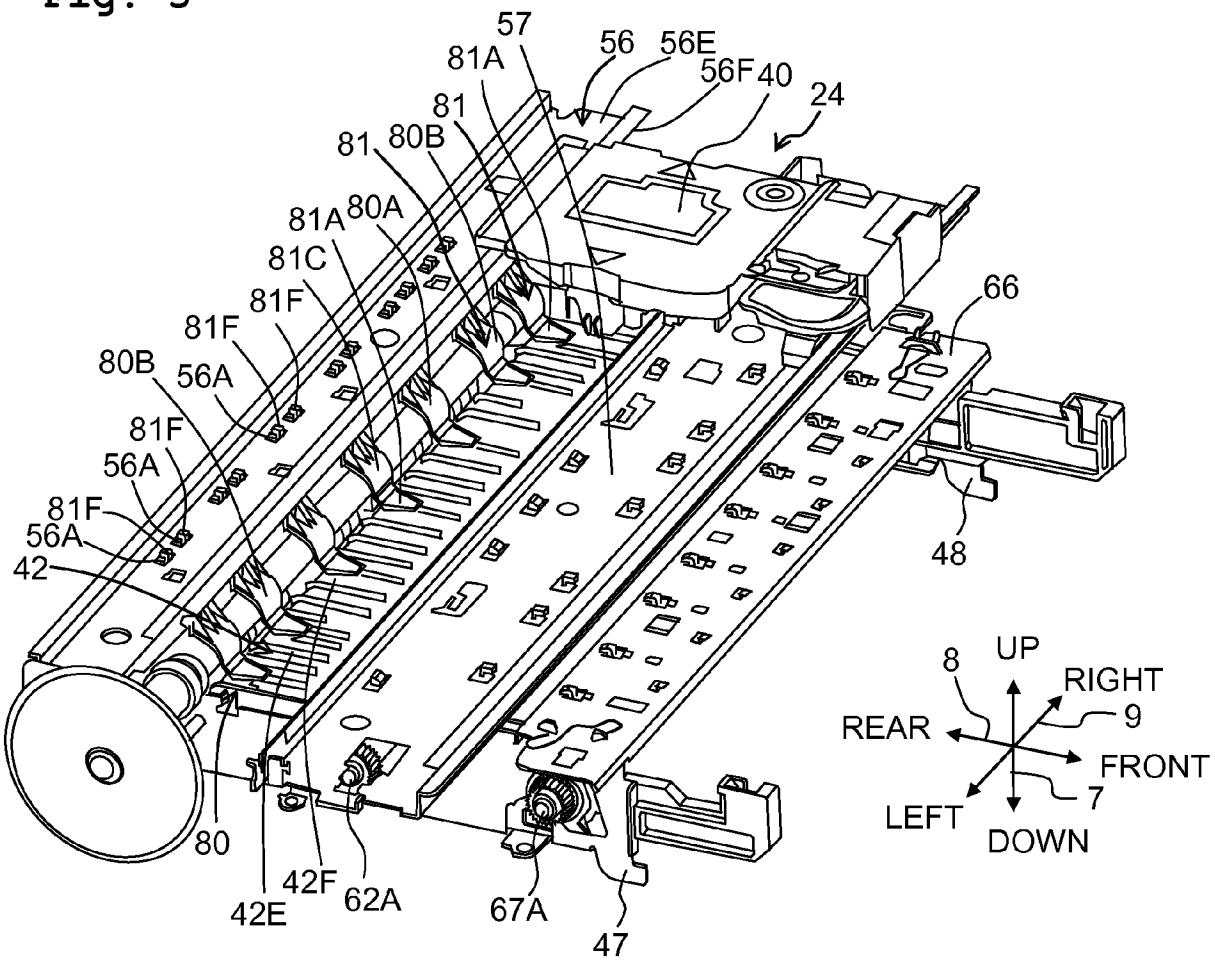
FIG. 3 is a perspective view depicting an area around a recording unit 24 of the printer unit 11, a first guide rail 56, and a second guide rail 57.

As depicted in FIG. 3, the printer unit 11 is supported by a left side frame 47 and a right side frame 48 which are disposed on the left and right sides of a rear part of the casing 14. Each of the left side frame 47 and the right side frame 48 is configured so that its longitudinal direction is the front-rear direction 8 and its width direction is the up-down direction 7.

The first guide rail 56 and the second guide rail 57 are supported by the left side frame 47 and the right side frame 48 in a state of being bridged or spanned therebetween. The front and rear parts of the carriage 40 of the recording head 24 are slidably supported by the first guide rail 56 and the second guide rail 57. The carriage 40 slidably moves on the front part of an upper surface 56E of the first guide rail 56.

A roller support frame 66 is supported by the left side frame 47 and the right side frame 48 on the front side of the second guide rail 57. The roller support frame 66 has a band plate shape to extend in the left-right direction 9. The facing roller 68, which is included in the reverse roller pair 45 and is disposed on the upper side (see FIG. 2), is attached to the lower side of the roller support frame 66.

Figure 5:
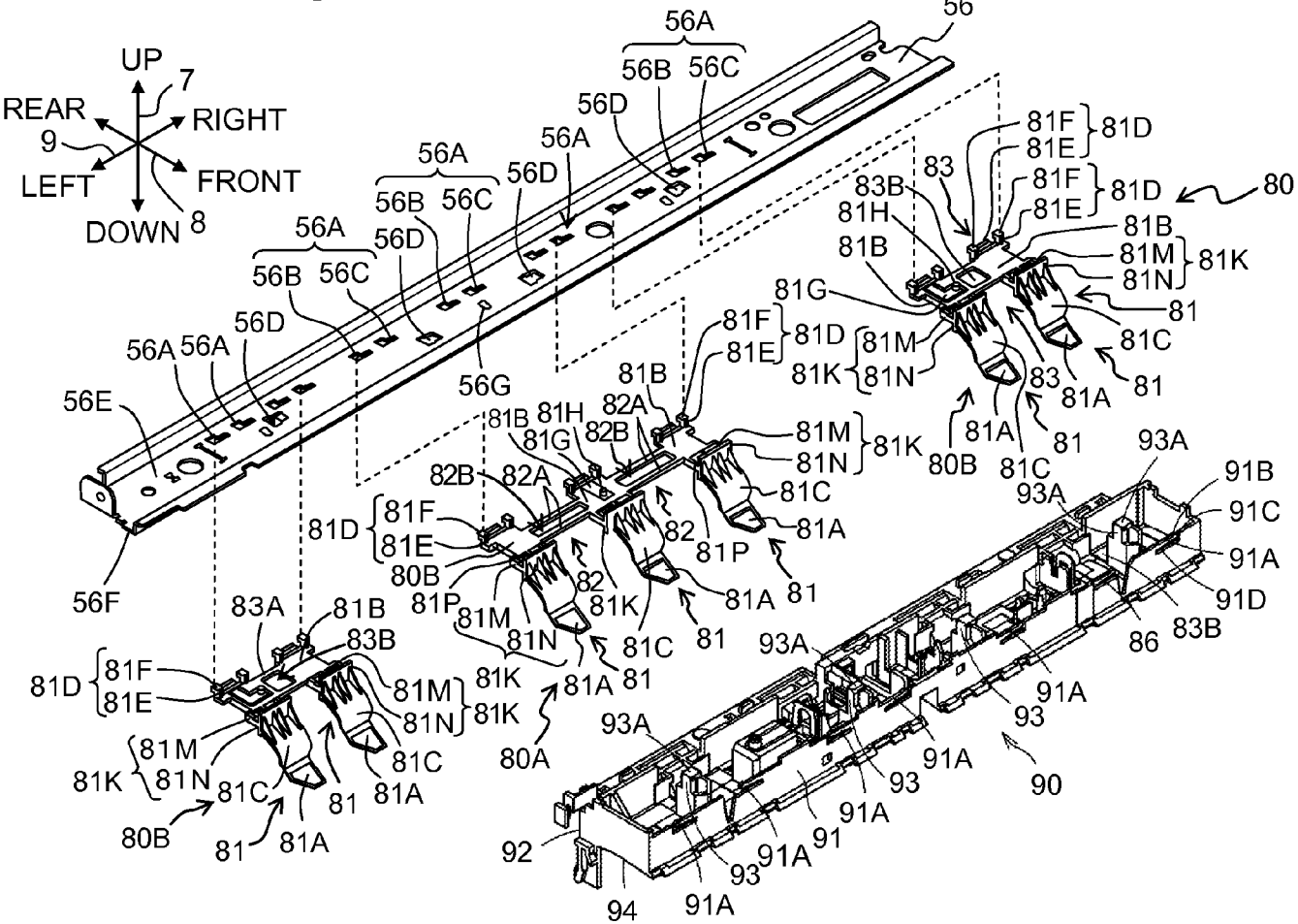
FIG. 5 is an exploded perspective view of the first guide rail 56, the corrugating unit 80, and an biasing member 90.

As depicted in FIG. 5, a corrugating unit 80 is provided on the lower side of the first guide rail 56. The corrugating unit 80 corrugates, in the left-right direction 9, the recording sheet 12 conveyed. The corrugating unit 80 includes a first contact member 80A provided in the center in the left-right direction 9 and second contact members 80B provided on left and right sides of the first contact member 80A. An urging or basing member 90, by which the first contact member 80A and the second contact members 80B are urged or biased against the first guide rail 56, is provided on the lower side of the first guide rail 56. The structure of the corrugating unit 80 and the biasing member 90 will be described later.

Figure 4:
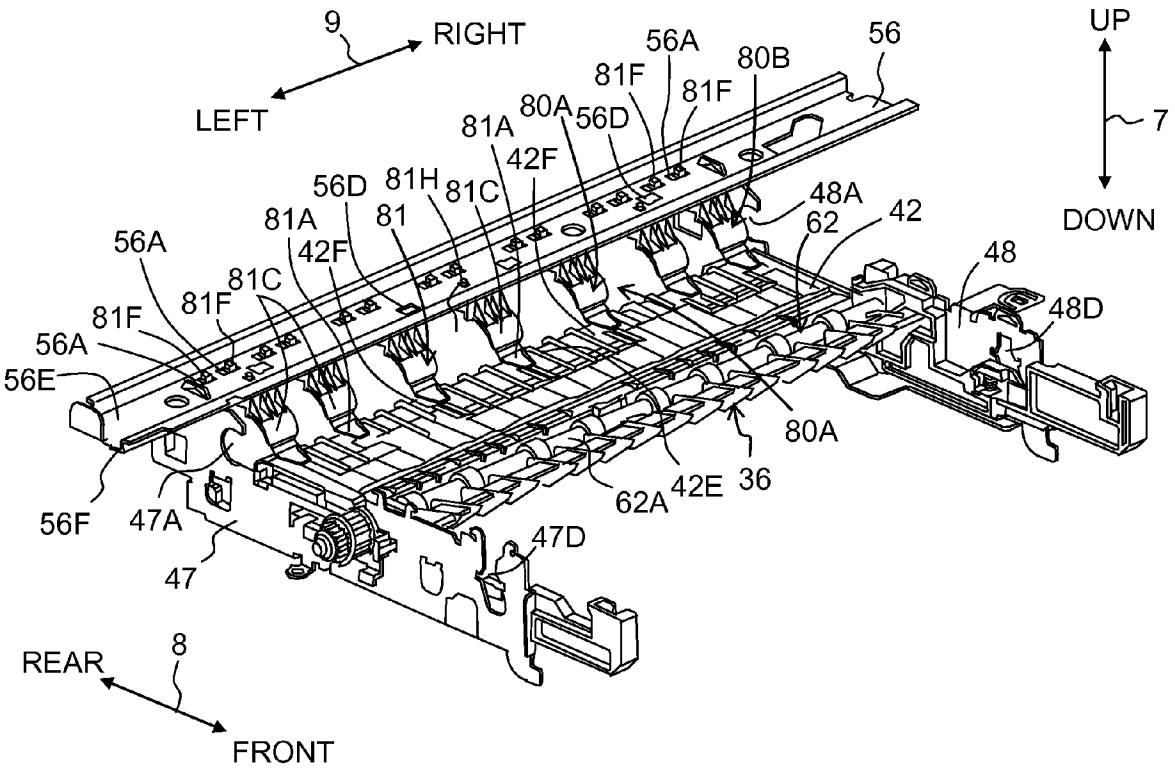
FIG. 4 is a perspective view depicting an area around the first guide rail 56 and a corrugating unit 80.

As depicted in FIG. 4, notches 47A and 48A are provided in the left side frame 47 and the right side frame 48 respectively. The notches 47A and 48A rotatably support a roller shaft 60A (see FIG. 2) of the first conveyance roller 60, which is included in the first conveyance roller pair 59 and is disposed on the upper side. This structure or configuration allows the first conveyance roller 60 to be in the state depicted in FIG. 3.

As depicted in FIG. 4, the ends of a roller shaft 62A of the second conveyance roller 62, which is included in the second conveyance roller pair 44 and is disposed on the lower side, are supported by the left side frame 47 and the right side frame 48, respectively. The roller shaft 62A of the second conveyance roller 62 is rotatably supported by support holes (not depicted) formed in the left side frame 47 and the right side frame 48 in a state of being movable in the up-down direction. The facing roller 63 (see FIG. 2), which is included in the second conveyance roller pair 44 and is disposed on the upper side, is attached to the lower side of the second guide rail 57 (see FIG. 3).

As depicted in FIG. 4, support holes 47D and 48D are provided in the left side frame 47 and the right side frame 48, respectively. The support holes 47D and 48D support the ends of a roller shaft 67A of the reverse roller 67, which is included in the reverse roller pair 45 and is disposed on the lower side. The roller shaft 67A of the reverse roller 67 is rotatably supported by the support holes 47D and 48D in a state of being moveable in the up-down direction. The platen 42 provided between the first conveyance roller pair 59 and the second conveyance roller pair 44 in the front-rear direction 8 is supported by the roller shaft 62A of the second conveyance roller 62.

<Platen 42>

As depicted in FIG. 4, the platen 42 has a band plate shape to extend in the left-right direction 9. The front edge of the platen 42 is rotatably supported by the roller shaft 62A of the second conveyance roller 62. The platen 42 includes, on the upper-rear surface thereof, contact areas 42F which make contact with contact parts 81A of the corrugating unit 80 respectively. The contact areas 42F are flat surfaces which can make contact with the entire lower surfaces of the flat plate-shaped contact parts 81A. The platen 42 further includes ribs (protrusions) 42E on the upper surface thereof. The ribs 42E protruding upward extend in the front-rear direction 8 with appropriate intervals in the left-right direction 9. The ribs 42E are provided in areas, except for the contact areas 42F, ranging from a rear part of the platen 42 to an approximately middle position of the left side frame 47 (right side frame 48) in the front-rear direction 8.

<Corrugating Unit 80>

As depicted in FIG. 5, the first contact member 80A is attached to the center part of the first guide rail 56 (a support member of the present teaching) in the left-right direction 9. The second contact members 80B are attached to the first guide rail 56 on left and right sides of the first contact member 80A with predetermined spacing distances in the left-right direction 9. The predetermined spacing distance between one of the second contact members 80B and the first contact member 80A is equal to the predetermined spacing distance between the other of the second contact members 80B and the first contact member 80A.

The first contact member 80A includes three contact bodies 81 and first connection units 82. The contact bodies 81 are disposed at intervals in the left-right direction 9. Each of the first connection units 82 connects the contact bodies 81 disposed adjacently to each other.

Each of the contact bodies 81 includes a base 81B, a connection part 81K, a curved part 81C, and the contact part 81A. The base 81B faces a lower surface 56F of the first guide rail 56. The connection part 81K is connected to the front end (the downstream end in the sheet conveyance direction) of the base 81B. The curved part 81C protrudes frontward and downward from the front end of the connection part 81K in a state of being curved. The contact part 81A is provided at the lower end (front end) of the curved part 81C.

The base 81B has a rectangular flat plate shape as viewed in plan view. The base 81B includes engaging parts 81D on the rear end thereof. The engaging parts 81D are engaged with the first guide rail 56. The engaging parts 81D include brace members (struts) 81E and latches (locking parts) 81F. The brace members 81E protrude upward from the rear end of the base 81B on the left and right sides. The latches 81F extend rearward at the tips of the brace members 81E. The brace members 81E have rectangular cross-sectional surfaces, that is, a length of the brace members 81E in the front-rear direction 8 (the sheet conveyance direction) and a length of the brace members 81E in the left-right direction 9 are constant.

The first guide rail 56 includes openings 56A into which the engaging parts 81D of the bases 81B are inserted. Each of the openings 56A is provided at a rear part of the first guide rail 56, that is, on the rear side of the slide position of the carriage 40 in the first guide rail 56. Each of the openings 56A includes a penetrating part 56B and a slide part 56C. The penetrating part 56B has a size to allow the latch 81F of the base 81B to penetrate therethrough. The slide part 56C extends rightward from the front part of the penetrating part 56B. The slide part 56C is formed to have a length in the front-rear direction 8 which allows the brace member 81E to penetrate therethough and does not allow the latch 81F to penetrate therethough.

The engaging parts 81D of the bases 81B of the contact bodies 81 are positioned on the upper side of the first guide rail 56 by inserting the latches 81F, from the lower side of the first guide rail 56, into the penetrating parts 56B of the openings 56A of the first guide rail 56. When the brace members 81E slide rightward along the slide parts 56C of the openings 56A in a state that the engaging parts 81D are positioned on the upper side of the first guide rail 56, the latches 81F of the engaging parts 81D are positioned on the upper side of the right ends of the slide parts 56C. This allows the latches 81F to be locked on the upper surface 56E of the first guide rail 56 so that the latches 81F fail to disengage therefrom.

The base 81B of the contact body 81 positioned in the center in the left-right direction 9 includes a plate spring 81G, which has a band plate shape to extend in the front-rear direction 8 and is disposed in the center in the left-right direction 9. The plate spring 81G is formed of a band plate portion, which is formed by cutting a part of the base 81B. The base 81B of the contact body 81 positioned in the center in the left-right direction 9 includes a boss 81H protruding upward at the front end of the plate spring 81G. The boss 81H fits in the opening 56G of the first guide rail 56 in a state that the engaging parts 81D of the base 81B are engaged with the first guide rail 56. The bases 81B, of the other two contact bodies 81, positioned on the left and right sides have no plate spring 81G.

Figure 6B:
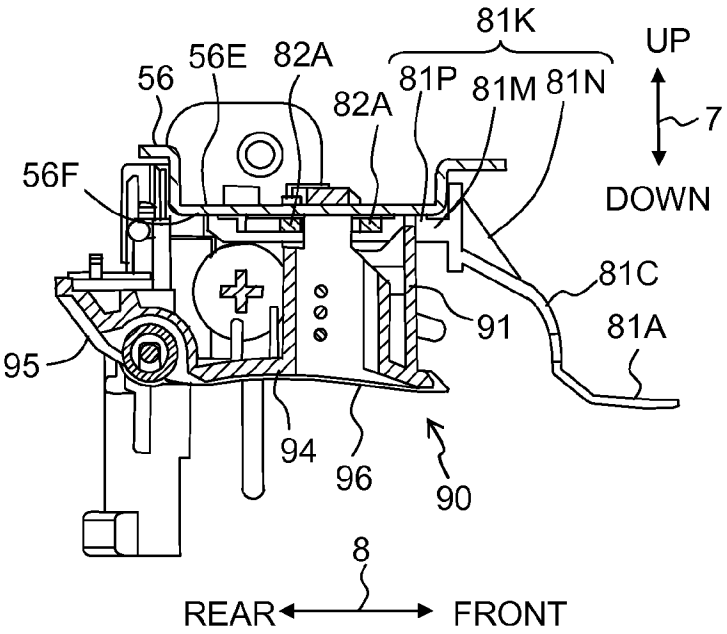
FIGS. 6A and 6B are transverse cross-section views of the first guide rail 56 and the corrugating unit 80.
Figure 6A:
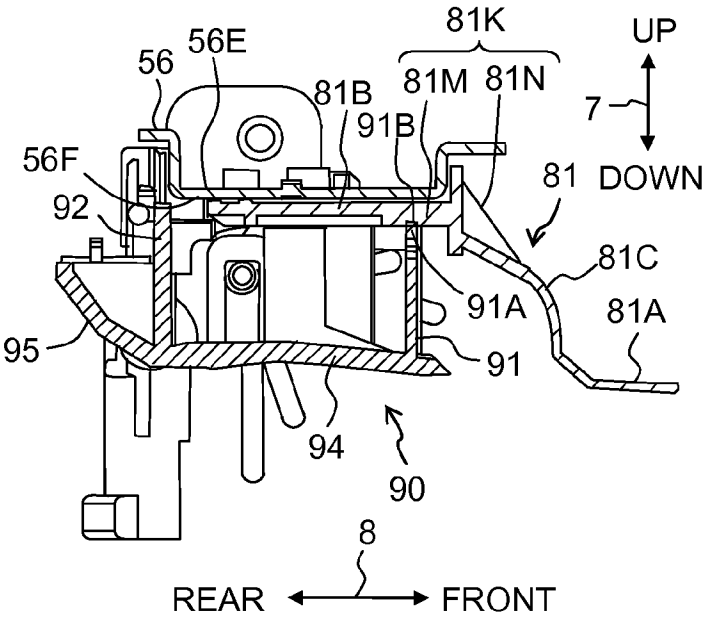

As depicted in FIG. 5, the connection part 81K provided between the base 81B and the curved part 81C includes three connection bodies 81M and a flat plate-shaped attachment part 81N. The three connection bodies 81M protrude frontward from the front surface of the base 81B with regular intervals in the left-right direction 9. The attachment part 81N is supported by the front ends of all of the connection bodies 81M in the up-down direction 7. The connection bodies 81M include, at rear parts thereof, protrusions 81P (see FIG. 6B) which protrude upward to make contact with the lower surface 56F of the first guide rail 56. The attachment part 81N extends in the up-down direction 7 and the left-right direction 9, and the middle in the up-down direction 7 is supported by the front ends of the connection bodies 81M. A part, of the attachment part 81N, on the upper side of the connection bodies 81M, extends along the front side edge of the first guide rail 56.

The upper end of the curved part 81C is attached to a lower part of the front surface of the attachment part 81N of the connection part 81K. The length of the curved part 81C in the left-right direction 9 is approximately constant, and the curved part 81C is formed to extend along the front-side outer circumferential parts of the first conveyance roller pair 59. The curved part 81C has flexibility to be movable in the up-down direction 7 and the front-rear direction 8.

The contact part 81A protrudes frontward from the lower end of the curved part 81C to have a triangle shape in which the length in the left-right direction 9 is narrower toward the front side as view in plan view. The contact parts 81A are positioned on the upstream side of the nozzles 39 of the recording unit 24 in the sheet conveyance direction. The contact parts 81A are brought into contact with the contact areas 42F of the upper rear surface of the platen 42 when no recording sheet 12 is being conveyed. When the recording sheet 12 is being conveyed, the contact parts 81A make contact with the recording sheet 12.

The end, of the flat plate-shaped contact part 81A of the contact body 81, on the downstream side in the sheet conveyance direction is substantially parallel to the recording sheet 12 conveyed. The structure of the contact part 81A is not limited to this, and the contact part 81A may be inclined upward in the sheet conveyance direction, namely may be inclined so that the most downstream part in the sheet conveyance direction is in the uppermost position.

The first connection unit 82 includes a pair of connection parts 82A which connects the bases 81B, of the contact bodies 81, disposed adjacently to each other. The pair of connection parts 82A is formed of wire rods which extend in the left-right direction 9 and have a constant length (width) in the front-rear direction 8. A hole 82B, of which length in the front-rear direction 8 is constant, is formed between the pair of connection parts 82A. The hole 82B is an elongated hole which is defined by the pair of connection parts 82A and the bases 81B disposed adjacently to each other. A gap is provided between the upper surfaces of the connection parts 82A and the lower surface of the first guide rail 56 in the up-down direction 7 in a state that the bases 81B are attached to the first guide rail 56. The length of the connection part 82A in the front-rear direction 8 is shorter than the length, of the brace member 81E of the engaging part 81D of the base 81B, in the front-rear direction 8.

The first connection unit 82 having such a structure is more likely to twist around an axis extending in the left-right direction 9 than the bases 81B disposed on left and right sides thereof. For example, when the rotative force around the axis 6, which extends in the left-right direction 9 and passes the center position of the first connection unit 82 in the front-rear direction 8, is applied on any one of the bases 81B, the first connection unit 82 is easily twisted around the axis 6 by the rotative force. This prevents the rotative force around the axis 6 from being transmitted to the other of bases 81B disposed adjacently to the first connection unit 82.

The first contact member 80A is made of synthetic resin (e.g. polyacetal (POM)) to include three contact bodies 81 and two first connection units 82 formed integrally.

As depicted in FIG. 5, each second contact member 80B includes two contact bodies 81 and a second connection unit 83 connecting the two contact bodies 81. The contact body 81 of the second contact member 80B on the left side has the same structure of that of the contact body 81 of the first contact member 80A in the central position, except that the contact body 81 of the second contact member 80B has a plate spring 81G having a shape different from that of the plate spring 81G of the base 81B of the first contact member 80A. Namely, the plate spring 81G of the second contact member 80B is formed so that the front end thereof extends rightward and the boss 81H is provided at the tip of the front end. The contact body 81 of the second contact member 80B on the right side has the same structure as those of the contact bodies 81 of the first contact member 80A on the left and right sides.

The interval, between two contact bodies 81 of the second contact member 80B, in the left-right direction 9 is shorter than the interval, between two contact bodies 81 disposed adjacently to each other in the first contact member 80A, in the left-right direction 9. The second connection unit 83 of the second contact member 80B includes a pair of connection parts 83A, and has the same structure as that of the first connection unit 82 of the first contact member 80A, except that the pair of connection parts 83A has a length shorter than that of the pair of connection parts 82A of the first connection unit 82. Thus, similar to the first connection unit 82 of the first contact member 80A, the second connection unit 83 of the second contact member 80B includes a hole 83B which is defined by the pair of connection parts 83A and the bases 81B disposed adjacently to each other. The length, of the hole 83B, in the left-right direction 9 is shorter than the length, of the hole 82B, in the left-right direction 9.

Similar to the first connection unit 82, the second connection unit 83 having such a structure is more likely to twist around the axis 6 than the bases 81B disposed on left and right sides thereof. For example, when the rotative force around the axis 6 is applied on any one of the bases 81B of the second connection unit 83, the second connection unit 83 is easily twisted around the axis 6 by the rotative force. This prevents the rotative force around the axis 6 from being transmitted to the other of bases 81B.

Similar to the first contact member 80A, the second contact member 80B is made of synthetic resin (e.g. polyacetal (POM)) to include two contact bodies 81 and the second connection unit 83 formed integrally. The first contact member 80A and the second contact members 80B, however, may not be formed integrally. Instead of the above structure, members may be combined or joined by fitting, engagement, or the like to form the first contact member 80A and the second contact members 80B.

<Biasing Member>

As depicted in FIG. 5, the first contact member 80A and the second contact members 80B are pressed by the biasing member 90 from the lower side in a state of being supported by the guide rail 56. The biasing member 90 is formed to have a substantially box shape which includes a front side wall 91 and a rear side wall 92 extending in the left-right direction 9.

Figure 7A:
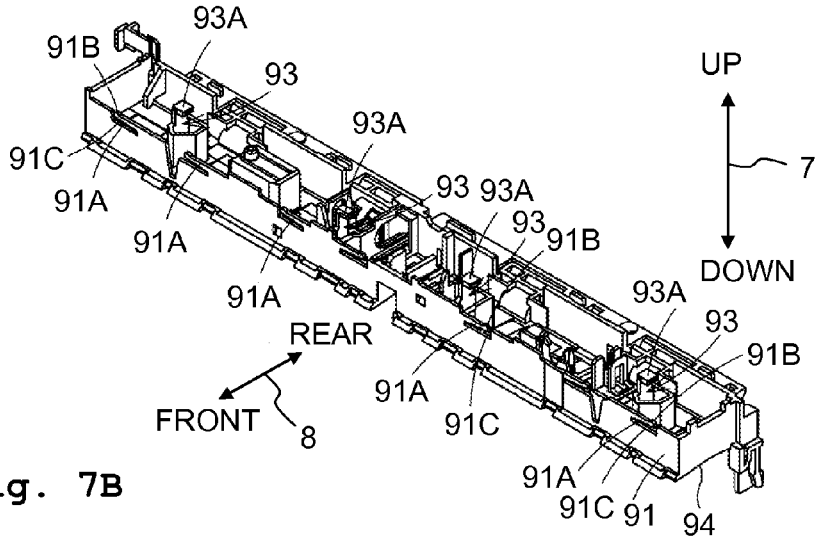
FIG. 7A is a perspective view of the biasing member 90 as viewed from the upper side.

As depicted in FIG. 7A, the front side wall 91 includes, at the upper edge thereof, urging parts 91A at intervals in the left-right direction 9. The urging parts 91A are positioned on the lower side of the bases 81B of the contact bodies 81 of the first contact member 80A and the second contact members 80B. The urging parts 91A each have a plate spring shape extending in the left-right direction 9. One end of each urging part 91A in its longitudinal direction is formed integrally with the front side wall 91, and a space 91C is formed to extend, along and below the urging part 91A, from the space between the other end (tip portion) of the urging part 91A in the longitudinal direction and the front side wall 91. This structure allows each urging part 91A to have flexibility, namely, the tip portion thereof can be displaced in the up-down direction 7.

Pressing parts 91B protruding upward are provided at the tip portions of the urging parts 91A, respectively. Each of the pressing parts 91B makes contact with the center, of the front part of the base 81B of the contact body 81, in the left-right direction 9, thereby pressing the front part of the base 81B upward.

As depicted in FIG. 7A, the biasing member 90 includes four support members 93 by which the biasing member 90 is supported by the first guide rail 56. The support members 93 protrude upward from the middle of a bottom plate 94 of the biasing member 90 in the front-rear direction 8, at regular intervals in the left-right direction 9. Engaging parts 93A extending frontward are provided at the upper ends of the support members 93. The number of support members 93 is not limited to four.

As depicted in FIG. 5, four engaging holes 56D are formed, along the left-right direction 9, in the middle of the first guide rail 56 in the front-rear direction 8, on the rear side of the sliding position of the carriage 40. The engaging holes 56D are provided at positions corresponding to the support members 93. The left part of each of the engaging holes 56D has a size to allow the engaging part 93A provided at the upper end of the support member 93 to pass therethrough. The right part of each of the engaging holes 56D does not allow the engaging part 93A to pass therethrough, but it has a size to allow a part provided on the lower side of the engaging part 93A to pass therethrough. Thus, the engaging parts 93A of the support members 93 can be engaged with the upper surface 56E of the first guide rail 56 by inserting the engaging parts 93A of the support members 93 into the left parts of the engaging holes 56D; positioning the engaging parts 93A on the upper side of the first guide rail 56; and sliding the engaging parts 93A rightward. The biasing member 90 is supported by the first guide rail 56 by engaging the engaging parts 93A of all of the support members 93 with the upper surface 56E of the first guide rail 56.

Supporting the biasing member 90 by the first guide rail 56 brings the pressing parts 91B of the urging parts 91A of the front side wall 91 into contact under pressure with the front parts of the bases 81B of the contact bodies 81. In this situation, the protrusions 81P of connection parts 81K of the contact bodies 81 are pressed against and brought into contact with the downstream end of the lower surface 56F of the first guide rail 56. The engaging parts 81D, which are provided at the rear parts of the bases 81B of the contact bodies 81, are engaged with the first guide rail 56, and thus the protrusions 81P of the connection parts 81K positioned on the front side of the bases 81 are pressed against the downstream end of the lower surface 56F of the first guide rail 56. This bends the curved parts 81C to cause the contact parts 81A, which are the lower ends of the curved parts 81C, to rise upward. As a result, the front ends of the contact parts 81A are displaced upward, which allows the contact parts 81A to be substantially parallel to the recording sheet 12 conveyed or to be inclined upward in the sheet conveyance direction.

Figure 7B:
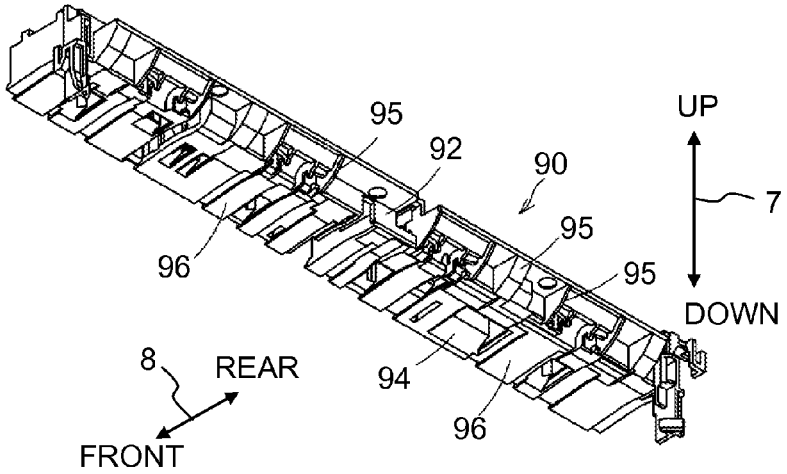
FIG. 7B is a perspective view of the biasing member 90 as viewed from the lower side.

As depicted in FIG. 7B, first guide members 95 are provided to protrude rearward from a lower part of the rear side wall 92 of the biasing member 90. The first guide members 95 are disposed at intervals in the left-right direction 9 to extend in the front-rear direction 8. The rear side edge of each first guide member 95 is inclined so that the rearmost portion thereof is positioned on the uppermost side. The rear end of each first guide member 95 is positioned at a height corresponding to the middle of the rear side wall 92 in the up-down direction 7. Each first guide member 95 guides the recording sheet 12, which is conveyed from the first conveyance path 33, to the lower side of the bottom plate 94 of the biasing member 90.

Second guide members 96 are provided on the lower surface of the bottom plate 94. The second guide members 96 guide the recording sheet 12, which is guided by the first guide members 95, to the first conveyance roller pair 59. The biasing member 90 is integrally formed by use of resin, namely the rear side wall 92 and the first guide members 95 are formed integrally, and the bottom plate 94 and the second guide members 96 are formed integrally.

<Action and Effect of Corrugating Unit 80 and Biasing Member 90>

When the recording sheet 12 fed from the feed tray 20 is conveyed to the first conveyance roller pair 59 through the first conveyance path 33 on the basis of the central positioning, the recording sheet 12 is conveyed on the platen 42 by being guided by the first guide members 95 and the second guide members 96 of the biasing member 90. In this situation, when the recording sheet 12 conveyed by the first conveyance roller pair 59 makes contact with the contact parts 81A of the contact bodies 81 of the first contact member 80A, the recording sheet 12 contacting with the contact parts 81A is pressed against the contact areas 42F of a platen body 42A. Since the ribs 42E are provided, along the front-rear direction 8, on left and right sides of the contact areas 42F, parts of the recording sheet 12 which are contacting with the contact parts 81A are positioned on the lower side of parts of the recording sheet 12 which are contacting with the ribs 42E, that is, the parts of the recording sheet 12 which are contacting with the contact parts 81A are farther away from the recording unit 24 than the parts of the recording sheet 12 which are contacting with the ribs 42E. Accordingly, the parts of the recording sheet 12 which are pressed against the contact areas 42F by means of the contact parts 81A are curved to protrude downward.

In this case, the reaction force from the recording sheet 12 is applied to the contact parts 81A of the contact bodies 81 of the first contact member 80A. This reaction force moves the contact parts 81A upward, thereby displacing the curved parts 81C upward. Then, the front ends of the bases 81B are displaced upward, as well. Here, each first connection unit 82 connecting the contact bodies 81 disposed adjacently to each other is formed of the pair of connection parts 82A with the hole 82B provided therebetween. Thus, when one or both of the contact bodies 81 is/are deformed, the first connection unit 82 twists to rotate around the axis 6. Namely, the twist of the first connection unit 82 prevents a situation in which the displacement of one of the contact bodies 81 disposed on left and right sides of the first connection unit 82 causes the displacement of the other of contact bodies 81. This prevents a situation in which the displacement of one of the contact bodies 81 changes the pressing force applied from the other of contact bodies 81 to the recording sheet 12.

The same is true on each of the second contact members 80B. When the contact parts 81A make contact with the recording sheet 12, parts, of the recording sheet 12, brought into contact with the contact parts 81A, are curved by being pressed against the contact areas 42F of the platen 42. Also in this case, when one of the contact bodies 81 disposed on left and right sides of the second connection unit 83 is displaced, the second connection unit 83 prevents the displacement of the other of contact bodies 81.

Accordingly, the recording sheet 12 is curved by the cooperation of the contact areas 42F of the platen 42, the ribs 42E disposed on left and right sides of each contact area 42F, and the contact parts 81A facing the contact areas 42F. In other words, the recording sheet 12 waves in the left-right direction 9. Then, the recording unit 24 records an image on the recording sheet 12 after the waving part of the recording sheet 12 is positioned at a predetermined position of the platen 42. In this case, since the recording sheet 12 has the waving part, cockling hardly occurs on the recording sheet 12 on which the image is to be formed by ink droplets.

The first contact member 80A and second contact members 80B are biased by the biasing member 90 toward the lower surface 56F of the first guide rail 56. In particular, the pressing parts 91B of the urging parts 91A formed at the upper edge of the front side wall 91 of the biasing member 90 press the connection parts 81K of the contact bodies 81. This allows the protrusions 81P of the connection parts 81K to be pressed against the lower surface 56F of the first guide rail 56.

When the engaging parts 81D of the contact bodies 81 and the protrusions 81P, of the connection parts 81K, disposed between the engaging parts 81D and the contact parts 81A in the front-rear direction 8 are pressed against the lower surface 56F of the first guide rail 56, the front ends of the contact parts 81A are displaced further upward as compared with the case in which the contact parts 81A are not biased by the biasing member 90. Accordingly, the contact parts 81A become substantially parallel to the recording sheet 12 conveyed through the second conveyance path 34, or are inclined upward so that the front ends of the contact parts 81A are positioned on the upper side of the recording sheet 12 in the sheet conveyance direction.

The contact parts 81A in the above states have the following advantages. Namely, when the paper jam of the recording sheet 12 occurs in the second conveyance path 34 and when the recording sheet 12 having the paper jam is pulled rearward from the second conveyance path 34, the front ends of the contact parts 81A rarely pierce the recording sheet 12. This can reduce the possibility in which the recording sheet 12 can not be pulled appropriately by being broken upon pulling from the second conveyance path 34. Further, when a media tray, on which a recording media is placed, is inserted from the front side into the second conveyance path 34 in order to record an image on a disk of the recording media such as CD-ROM and DVD-ROM, the front ends of the contact parts 81A rarely make contact with the media tray.

Since the contact parts 81A are in a predetermined state by bringing the biasing member 90 into contact with the contact bodies 81 from the lower side of the first guide rail 56, the contact parts 81A do not negatively affect the sliding movement of the carriage 40 on the first guide rail 56.

Effects of the Embodiment

According the embodiment, the contact parts 81A are allowed to be in the predetermined state easily by pressing the contact bodies 81 against the lower surface 56F of the first guide rail 56 while urging the contact bodies 81 upward by means of the urging parts 91A of the biasing member 90.

The biasing member 90 includes the first guide members 95 and second guide members 96 which guide the recording sheet 12 conveyed through the second conveyance path 34 onto the platen 42. The biasing member 90 including the first guide members 95 and second guide members 96 is integrally formed by use of resin. This can reduce the space where the first guide members 95 and second guide members 96 are disposed and no assembling work is required.

The second guide members 96, which guide the recording sheet 12 conveyed through the second conveyance path 34 onto the platen 42, are provided on the bottom plate 94 of the biasing member 90. Namely, the biasing member 90 is provided between the second guide members 96 and the first and second contact members 80A, 80B. This downsizes the multifunction peripheral 10.

The biasing member 90 and coil springs 65 bring the contact bodies 81 into contact with the side part, of the lower surface 56F of the first guide rail 56, on the downstream side in the sheet conveyance direction. This makes it easy to adjust the positions of the contact bodies 81 relative to the lower surface 56F of the first guide rail 56.

Since the recording unit 24 is movably supported by the upper surface 56E of the first guide rail 56 in a direction intersecting with the sheet conveyance direction, there is no need to provide any special member for attaching the first contact member 80A and the second contact member 80B.

The first guide rail 56 includes the openings 56A penetrating the upper surface 56E and the lower surface 56F. Each of the engaging parts 81D of the contact bodies 81 includes the brace member 81E penetrating the opening 56A and the latch 81F extending from the brace member 81E to make contact with the upper surface 56E of the first guide rail 56. This makes it possible to engage the engaging parts 81D with the first guide rail 56 easily, thereby allowing the contact bodies 81 to be attached to the first guide rail 56 easily.

Since the first contact member 80A and the second contact member 80B are provided at intervals in the left-right direction 9, the recording sheet 12 conveyed therethrough can be pressed in the left-right direction 9.

The contact parts 81A press the recording sheet 12 against the contact areas 42F between the ribs 42E of the platen 42. The cooperation of the contact parts 81A and the ribs 42E waves the recording sheet 12 in the left-right direction 9.

Each of the contact parts 81A has the flat plate shape and is disposed to be parallel to the recording sheet 12 conveyed therethrough or to be inclined upward in the sheet conveyance direction. This prevents the contact parts 81A from damaging the recording sheet 12 when the recording sheet 12 making contact with the contact parts 81A moves in the opposite direction of the sheet conveyance direction.

Since an image is recorded on the recording sheet 12 by allowing the recording unit 24 to discharge ink droplets from the nozzles 39, the image formed with the ink droplets can have higher image quality.

Modified Embodiments

Figure 8:
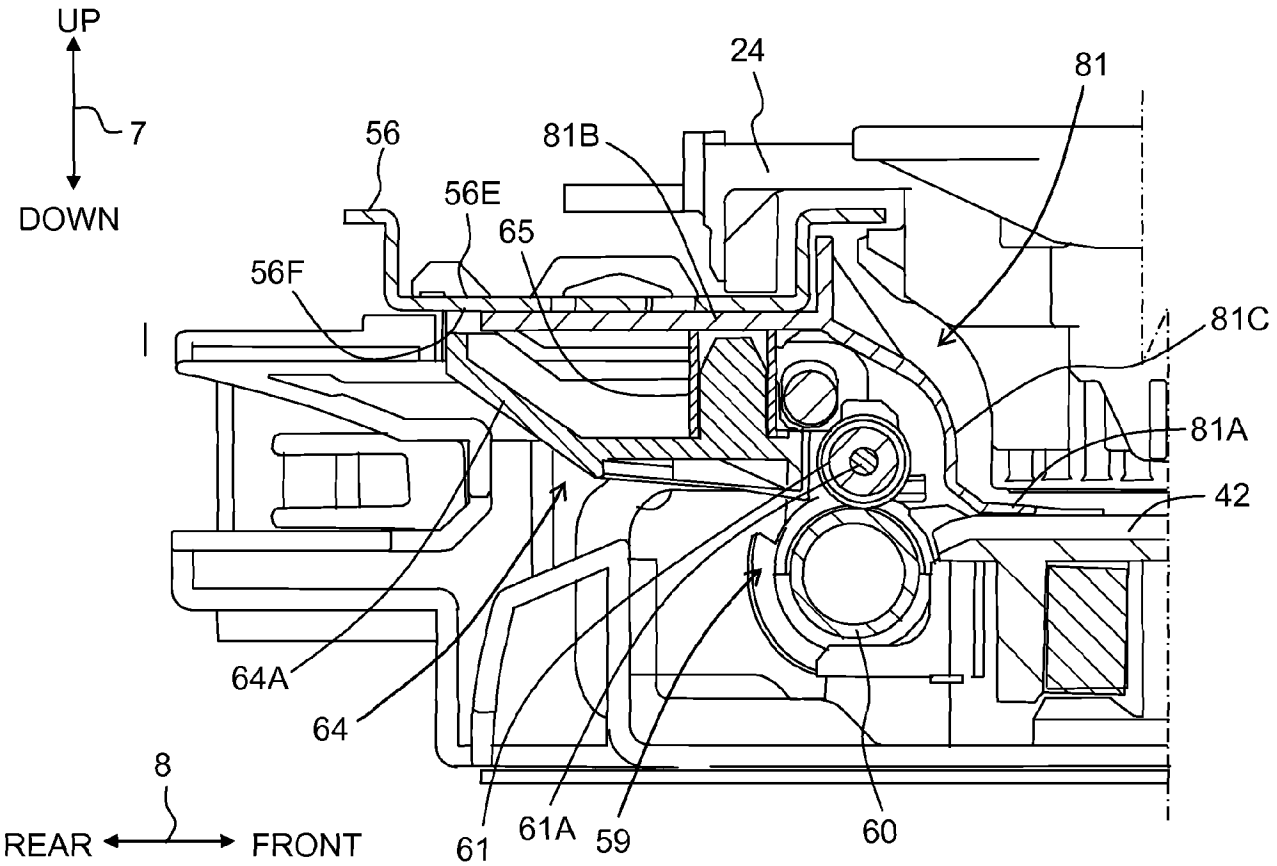
FIG. 8 is a cross-sectional view of the first guide rail 56, the corrugating unit 80, and a first conveyance roller pair 59 according to a modified embodiment of the present teaching.

In the modified embodiment depicted in FIG. 8, the first conveyance roller 60 of the first conveyance roller pair 59 is provided on the lower side of the second conveyance path 34, and the pinch roller (driven roller) 61 is provided on the upper side of the second conveyance path 34. A roller shaft 61A of the pinch roller 61 is supported by a roller holder 64. The roller holder 64 includes a holder body 64A, which is supported by the first guide rail 56 on the rear side of the pinch roller 61. The roller shaft 61A of the pinch roller 61 is rotatably supported by an arm (not depicted) protruding frontward from the holder body 64A.

A rear part of the holder body 64A penetrates a rear part of the first guide rail 56 to be rotatably engaged with the upper surface of the first guide rail 56. This allows the pinch roller 61 to swing in a direction making contact with or being separated from the first conveyance roller 60.

The holder body 64A of the roller holder 64 includes the coil springs (biasing members) 65 supported in the up-down direction. The coil springs 65 are provided corresponding to the contact bodies 81 of the first and second contact members 80A, 80B. The upper end of each of the coil springs 65 is brought into with the lower surface of a front part (the downstream end of the recording sheet 12 in the sheet conveyance direction) of the base 81B of each of the contact bodies 81. Since each of the coil springs 65 is brought into contact with the base 81B of each of the contact bodies 81 in a state of being supported by the holder body 64A, the pinch roller 61 is brought into pressure contact with the first conveyance roller 60.

In the structure according to the modified embodiment, the contact bodies 81 are pressed against the lower surface 56F of the first guide rail 56 by being biased upward by the coil springs 65 disposed on the lower side. Thus, effects similar to those of the embodiment can be obtained. Further, the coil springs 65 urging the pinch roller 61 can bias the contact bodies 81, and thus the number of parts or components can be reduced.

Other Embodiments

The contact parts 81A of the contact bodies 81 of the first and second contact members 80A and 80B may not be configured to curve the recording sheet 12. The contact parts 81A may be configured to make contact with the recording sheet 12 from the upper side to prevent the recording sheet 12 from floating from the platen 42. This prevents the recording sheet 12 from making contact with the recording head 38 of the recoding unit 24. In this case, the platen 42 may not include the ribs 42E, or the contact parts 81A may be disposed to be always positioned on the upper side of the contact areas 42F between ribs 42E of the platen 42.

In the above embodiment, the first contact member 80A and the second contact members 80B are disposed on the upstream side of the recording unit 24 in the sheet conveyance direction. The first contact member 80A and the second contact members 80B, however, may be disposed on the downstream side of the recording unit 24 in the sheet conveyance direction.

The corrugating unit 80 may be configured so that each of the contact bodies 81 of the first contact member 80A and the second contact members 80B is provided independently of each other.

In the above embodiment, the first conveyance path 33 and the second conveyance path 34 are configured to convey the recording sheet 12 on the basis of the center positioning and the recording unit 24 is configured to record an image on the recording sheet 12 on the basis of the center positioning. However, the following structure or configuration is also allowable. That is, the recording sheet 12 is conveyed through the first conveyance path 33 and the second conveyance path 34 on the basis of one-side positioning, namely the recording sheet 12 is conveyed on the basis of any one of side edges of the recording sheet 12 in the width direction perpendicular to the sheet conveyance direction. In this case, an image is formed on the recording sheet 12 on the basis of one-side positioning, namely the image is formed on the basis of any one of side edges of the recording sheet 12 in the width direction.

What is claimed is:

1. An image recording apparatus configured to record an image on a sheet, comprising:

a conveyance unit configured to convey the sheet in a sheet conveyance direction;

a recording unit configured to record the image on the sheet conveyed by the conveyance unit;

a support member having a first surface and a second surface which is opposite to the first surface, the first surface being configured to support the recording unit;

a contact member including an engaging part configured to engage with the first surface and a contact part configured to make contact with the sheet on a downstream side of the engaging part in the sheet conveyance direction; and a biasing member configured to bias the contact member toward the second surface of the support member between the contact part and the engaging part in the sheet conveyance direction, and thereby making the contact member contact the second surface.

2. The image recording apparatus according to claim 1, further comprising a guide member configured to guide the sheet conveyed, wherein the biasing member is formed integrally with the guide member.

3. The image recording apparatus according to claim 2, wherein the guide member is disposed on an upstream side of the conveyance unit in the sheet conveyance direction.

4. The image recording apparatus according to claim 1, further comprising a guide member configured to guide the sheet conveyed, wherein the biasing member is provided between the guide member and the contact member to bias the contact member in a direction away from the guide member.

5. The image recording apparatus according to claim 4, wherein the guide member is disposed on an upstream side of the conveyance unit in the sheet conveyance direction.

6. The image recording apparatus according to claim 1, wherein the conveyance unit includes a conveyance roller, a driven roller disposed to face the conveyance roller, and a roller holder configured to rotatably hold the driven roller;

the roller holder is supported by the support member; and the biasing member is configured to bias the driven roller toward the conveyance roller while urging the roller holder.

7. The image recording apparatus according to claim 1, wherein the biasing member is configured to make the contact member contact with a downstream end, of the second surface of the support member, in the sheet conveyance direction.

8. The image recording apparatus according to claim 1, wherein the recording unit is movably supported by the first surface of the support member in a direction intersecting with the sheet conveyance direction.

9. The image recording apparatus according to claim 1, wherein the support member includes an opening the first surface and the second surface, and wherein the engaging part includes a brace member passing through the opening and a latch extending from the brace member to make contact with the first surface.

10. The image recording apparatus according to claim 1, wherein the contact member includes contact members at intervals in a width direction orthogonal to the sheet conveyance direction.

11. The image recording apparatus according to claim 10, further comprising a platen disposed to face the recording unit and configured to hold the sheet conveyed from the conveyance unit, wherein the platen includes ribs, which are disposed not to overlap with the contact parts of the contact members and are configured to work in cooperation with the contact parts to wave the sheet.

12. The image recording apparatus according to claim 1, wherein the contact part has a flat plate shape and is disposed to be parallel to the sheet conveyed or to be inclined upward in the sheet conveyance direction.

13. The image recording apparatus according to claim 1, wherein the recording unit is configured to record the image on the sheet by discharging ink droplets from nozzles.

* * * * *